US012089789B2

(12) United States Patent
Luong et al.

(10) Patent No.: US 12,089,789 B2
(45) Date of Patent: Sep. 17, 2024

(54) PEDICURE CHAIR ASSEMBLY HAVING BASIN

(71) Applicant: Lexor, Inc., Westminster, CA (US)

(72) Inventors: Christopher L. Luong, Westminster, CA (US); Long Luong, Irvine, CA (US); Quang Nguyen, Irvine, CA (US)

(73) Assignee: Lexor, Inc., Westminster, CA (US)

( * ) Notice: Subject to any disclaimer, the term of this patent is extended or adjusted under 35 U.S.C. 154(b) by 60 days.

(21) Appl. No.: 17/814,481

(22) Filed: Jul. 22, 2022

(65) Prior Publication Data

US 2023/0027946 A1 Jan. 26, 2023

Related U.S. Application Data

(60) Provisional application No. 63/224,492, filed on Jul. 22, 2021.

(51) Int. Cl.
*A47K 1/14* (2006.01)
*A47K 3/022* (2006.01)

(52) U.S. Cl.
CPC ..... *A47K 1/14* (2013.01); *A47K 3/022* (2013.01)

(58) Field of Classification Search
CPC ..... A47K 1/14; A47K 3/022
USPC ..... 4/287, 288, 292, 693, 286
See application file for complete search history.

(56) References Cited

U.S. PATENT DOCUMENTS

D454,705 S * 3/2002 Long ..... D6/336
6,367,102 B1 * 4/2002 McMullen ..... E03C 1/23 4/689
7,052,082 B1 * 5/2006 Thomas ..... A47C 1/11 297/148
7,181,782 B2 * 2/2007 Mayer ..... E03C 1/22 4/686
8,256,040 B2 * 9/2012 Park ..... A61H 35/006 510/130
8,296,874 B2 * 10/2012 Galati, Jr. ..... A47K 3/022 601/158
8,646,122 B2 * 2/2014 Ton ..... A61H 35/006 4/622
RE45,844 E * 1/2016 Long ..... A61H 33/6063
10,542,847 B2 * 1/2020 Luong ..... A61H 35/006
11,613,879 B2 * 3/2023 Ta ..... E03C 1/244 4/655

(Continued)

FOREIGN PATENT DOCUMENTS

CA 2798792 A1 * 5/2014 ..... A61H 33/0087
EP 3868965 A1 * 8/2021
WO WO-2018129542 A1 * 7/2018 ..... A47C 1/04

*Primary Examiner* — Lori L Baker

(74) *Attorney, Agent, or Firm* — Alumen IP Law PC

(57) ABSTRACT

A pedicure chair is provisioned to receive a separately formed basis or is unitarily formed with a basin. The basin can be equipped with a drain shoe at the drain hole having guide walls and guide slots for readily receiving a stopper to control drainage through the drain pipe. A treatment fluid delivery system can be included to provide treatment fluid to the basin to mix with an amount of fluid in the basin. The treatment fluid delivery system can include a steamer, a secondary fluid product source, and a safety device for regulating flow into the basin. A header or dispenser can be provided within the basin to distribute flow from the treatment fluid delivery system.

20 Claims, 9 Drawing Sheets

(56) References Cited

U.S. PATENT DOCUMENTS

| | | | | |
|---|---|---|---|---|
| 2007/0136944 | A1* | 6/2007 | Long | A61H 35/006 4/622 |
| 2009/0100590 | A1* | 4/2009 | Galati, Jr. | A61H 35/006 4/541.3 |
| 2011/0004994 | A1* | 1/2011 | Le | A61H 35/006 4/541.1 |
| 2011/0094026 | A1* | 4/2011 | Ton | A61H 35/006 4/541.6 |
| 2011/0271974 | A1* | 11/2011 | Park | A61H 35/006 132/200 |
| 2012/0246820 | A1* | 10/2012 | Huynh | A61H 35/006 4/524 |
| 2013/0019394 | A1* | 1/2013 | Tran | A47C 15/00 4/590 |
| 2013/0061390 | A1* | 3/2013 | Galati, Jr. | A61H 35/006 4/622 |
| 2015/0040310 | A1* | 2/2015 | Long | A47K 3/022 392/471 |
| 2015/0284938 | A1* | 10/2015 | Lechaton | E03C 1/262 4/689 |
| 2017/0260723 | A1* | 9/2017 | Zhou | E03C 1/23 |
| 2019/0104891 | A1* | 4/2019 | Tran | A61H 33/005 |
| 2020/0345579 | A1* | 11/2020 | Luong | A47C 1/11 |
| 2021/0077346 | A1* | 3/2021 | Luong | A47C 1/04 |

* cited by examiner

PEDICURE CHAIR ASSEMBLY HAVING BASIN

CROSS-REFERENCE TO RELATED APPLICATION(S)

This is a regular utility application of provisional application Ser. No. 63/224,492, filed Jul. 22, 2021, the contents of which are expressly incorporated herein by reference.

BACKGROUND

Pedicure therapy can include placing a patient's foot within a basin of liquid, such as moving warm or heated water within a hot tub or a jacuzzi. Some pedicure therapists seek to replicate this therapy by placing a basin in front of a chair filled with water. However, the water in such basins are static and do not move. While pedicure chairs could include a pipe system to introduce water into and out of the chair's basin, providing some modicum of moving water within the basin, such chairs are expensive to build and maintain, as they have more moving parts with moving liquids within them, than standard chairs. As such, building and maintenance of such chairs can be expensive and cumbersome.

Thus, there is a need for improved pedicure basins to provide pedicure therapies to a seated patient.

SUMMARY

Aspects of the invention include a pedicure basin. In an example, the pedicure basin comprises a side wall and a bottom surface; a drain hole disposed in the bottom surface; a stopper configured to extend into the drain hole, the stopper having a head comprising a stopper flange configured to engage the bottom surface adjacent the drain hole so as to plug the drain hole, an attachment member extending from the head; and a dispenser having a connector configured to releasably engage the attachment member so as to hold the dispenser connected to the head of the stopper; wherein when the connector is engaged with the attachment member the dispenser is held in place in the basin by the stopper.

The connector an comprise at least one inwardly-directed flexible tab and the attachment member can comprise a slot, and wherein when the connector is advanced over the attachment member the flexible tab can be retained within the slot.

The attachment member can comprise a circumferential ridge disposed above the circumferential slot, and the connector can comprise a ring having at least one flexible tab extending inwardly from the ring, a connector diameter can be defined between inward-most ends of diametrically-opposed portions of the at least one flexible tab, and wherein a maximum diameter of the circumferential ridge can be greater than the connector diameter.

The dispenser can comprise a first member and a second member, the first member can have a fluid connector and an elongated slot having a first side wall and a second side wall, the elongated slot can communicate with the fluid connector. A plurality of side slots can be formed through the first side wall, the second member can be configured to mate with the first member so as to enclose the elongated slot to define a manifold and to close the side slots so as to define delivery openings communicating with the manifold.

The first member can be hingedly connected to the second member.

The elongated slot can define a circle, and wherein a top wall of the first member can comprise a skirt portion that extends radially outwardly from the first side wall.

The upper opening of the basin can be located below a seating surface of a pedicure chair.

A still further aspect of the invention includes a pedicure basin comprising: a side wall and a bottom surface; a drain hole disposed in the bottom surface; a drain shoe fitted into the drain hole, the drain shoe defining an elongated drain passage has a guide wall pair extending transversely from an inner wall of the drain passage, the guide wall pair defining a guide slot therebetween; and a stopper configured to extend into the drain shoe, the stopper having a head comprising a stopper flange configured to engage the bottom surface adjacent the drain shoe so as to plug the drain hole, the stopper having an elongated body extending from the head and having a blade extending radially outwardly from the elongated body; wherein when the stopper is placed into the drain shoe, the blade slides within the guide slot.

elongated body of the stopper can have a plurality of blades extending radially outwardly from the elongated body, and the drain shoe can comprise a corresponding plurality of guide wall pairs that each define a guide slot therebetween, and wherein the plurality of guide slots can be arranged complementary to the plurality of blades.

A plurality of ring walls defining a center passage of the drain passage can be included, the center passage can be sized to accommodate the elongated body of the stopper.

The pedicure basin can additionally comprising an aligner atop at least one of the ring walls, the aligner can have a tip and an inclined surface sloping downwardly from the tip to an adjacent guide slot.

A still further aspect of the invention includes a method of establishing a drain in a pedicure basin. The pedicure basin can have a bottom surface and a drain passage defined by a drain shoe. The method can comprise installing a thin, flexible liner into a pedicure basin so that a bottom portion of the liner overlies the drain shoe, the drain shoe having a plurality of guide slots defined between a corresponding plurality of guide wall pair that extend inwardly from an inner wall of the drain passage, an aligner having a tip and an inclined surface sloping downwardly from the tip to a corresponding guide slot; advancing a stopper into contact with the liner and into the drain passage so that a blade of the stopper contacts the aligner; allowing the stopper to rotate about a vertical axis as the blade slides over the inclined surface until the blade is aligned with the guide slot; and advancing the stopper downwardly so that the blade moves downwardly through the guide slot, the guide wall pair restricts movement of the liner relative to the guide slot, and the blade cuts through the liner.

Aspects of the invention further include a pedicure chair comprising a basin, said basin comprising: a side wall and a bottom surface; a drain hole disposed in the bottom surface; a drain shoe fitted into the drain hole, the drain shoe defining an elongated drain passage and having an aligner with inclined surfaces; a stopper configured to extend into the drain shoe, the stopper having a head and an elongated body extending from the head and having a blade extending radially outwardly from the elongated body that is sized and shaped to be rotated by the aligner; a dispenser having a connector and an attachment member; wherein when the connector is engaged with the attachment member the dispenser is held in place in the basin by the stopper.

Methods of use and methods of making the pedicure chair and components thereof are understood to be included within the scope of the invention.

The summary is representative of the device, system, and method of the disclosed invention only and not to be construed as limiting the invention to the particular embodiments summarized herein.

BRIEF DESCRIPTION OF THE DRAWINGS

These and other features and advantages of the present devices, systems, and methods will become appreciated as the same becomes better understood with reference to the specification, claims and appended drawings wherein:

DESCRIPTION

The detailed description set forth below in connection with the appended drawings is intended as a description of the presently preferred embodiments of pedicure chairs provided in accordance with aspects of the present devices, systems, and methods and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Descriptions of technical features or aspects of an exemplary configuration of the disclosure should typically be considered as available and applicable to other similar features or aspects in another exemplary configuration of the disclosure. Accordingly, technical features described herein according to one exemplary configuration of the disclosure may be applicable to other exemplary configurations of the disclosure, and thus duplicative descriptions may be omitted herein.

The present disclosure describes embodiments in the context of a pedicure chair apparatus having a basin. Some aspects of pedicure chair apparatus that may provide context for this disclosure can be found in US Publication No. 2021/0077346, the contents of which are expressly incorporated herein by reference as part of the present disclosure.

Figure 1:
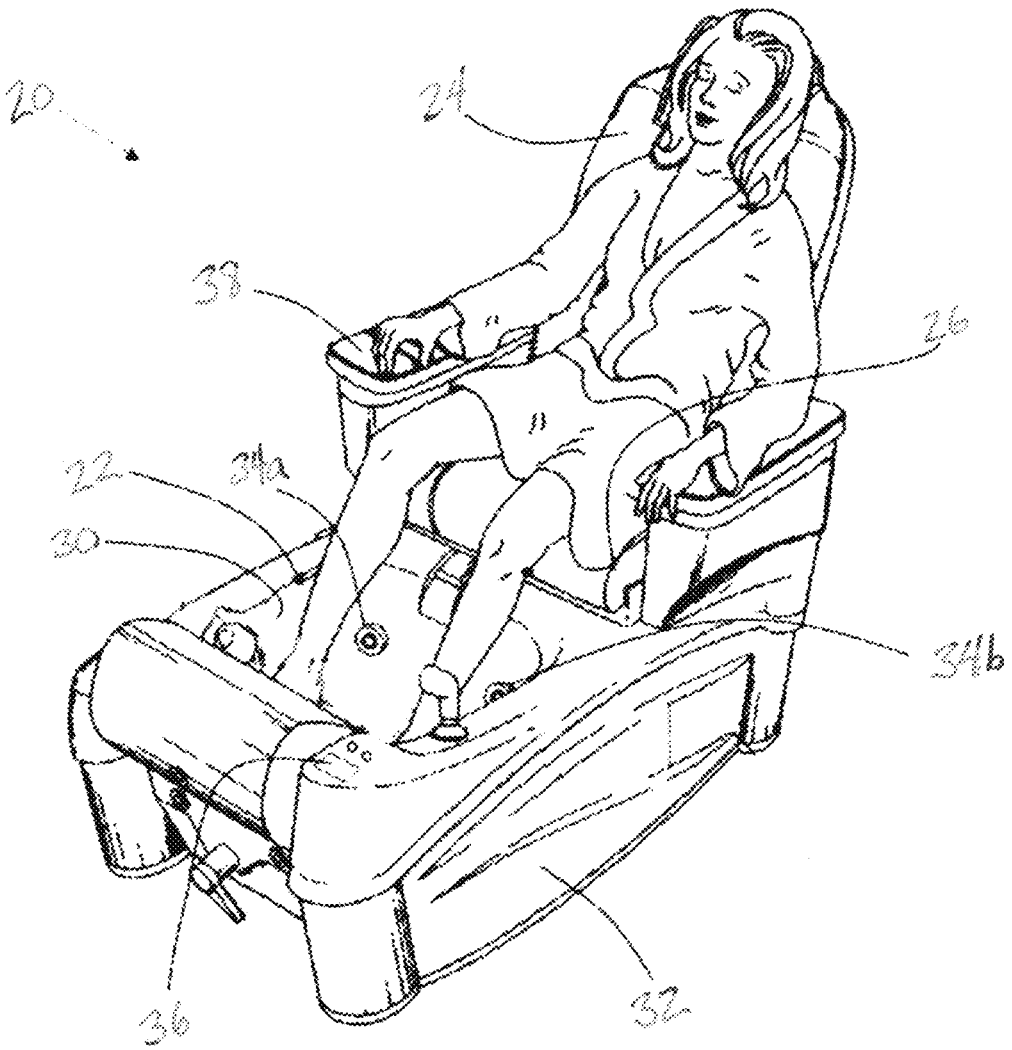
FIG. 1 is a schematic perspective view of a pedicure chair assembly comprising a basin and a seat having a seating surface upon which a user can sit.

With initial reference to FIG. 1, a pedicure chair assembly 20 comprises a basin 22 and a seat 24 having a seating surface 26 upon which a user can sit. The open end of the basin 22 is located below, elevation-wise, the seating surface 26 of the pedicure chair 20. The basin 22 has a cavity or holding space 30 that is sized and disposed to receive a quantity of water and a person's feet when the person is in a seated position in the pedicure chair 20.

In FIG. 1, the basin 22 is unitarily formed with the chair cover or body 32. However, in other embodiments the basin 22 could be a separate component, such as a separately formed basin, that is placed in a frame or structure for supporting the separately formed basin 22 in front of the seat 24. Preferably, the chair body 32 comprises a cavity that is sized and disposed to accept the separately formed basin 22, and comprises an attachment mechanism that holds the separately formed basin in place within the cavity, for example by using clamps, fasteners, a clasp, matching indents and detents, or an elastic band. In such embodiments, or in embodiments where the basin is placed in front of a chair 24, the chair body 32 and basin 22 could comprise different materials, similar to an opening of a counter-top for a sink. In such embodiments, the chair body 32 could comprise materials that are not waterproof, or less water resistant, while the basin 22 could comprise materials that are waterproof without damaging the non-waterproof portions of chair body 32. The basin 22 could be made of any suitable material, but is preferably made from a waterproof material, such as thermoplastic, ceramic, resin, or glass, and could be made to be opaque, translucent, or transparent material(s).

The basin 22 could be filled to a desired height or partially filled with water, such as with a pitcher, a hose, or via water supply outlets 34*a* and 34*b* connected to a water supply source. In some embodiments, one or both outlets 34*a*, 34*b* can instead be pump covers for a jet pump or pumps to circulate water within the basin, after the basin 22 has been filled by a hose, a pitcher, or a water supply line. Exemplary jet pumps usable with the pedicure chair of the present invention are disclosed in U.S. Pub. No. 2007/0136943, the contents of which are expressly incorporated herein by reference.

One or more control interfaces, such as control panel 36 or control panel 38, can be used to interact with one or more controllers to control operation of components and/or systems of the apparatus. For example, the control panels 36, 38 can be used to direct power adjustments to the chair, operation of a jet pump within the basin, or other functions and structures, such as for adjusting audio functions, video functions, music, and/or the heater setting for the water heater.

Figure 2:
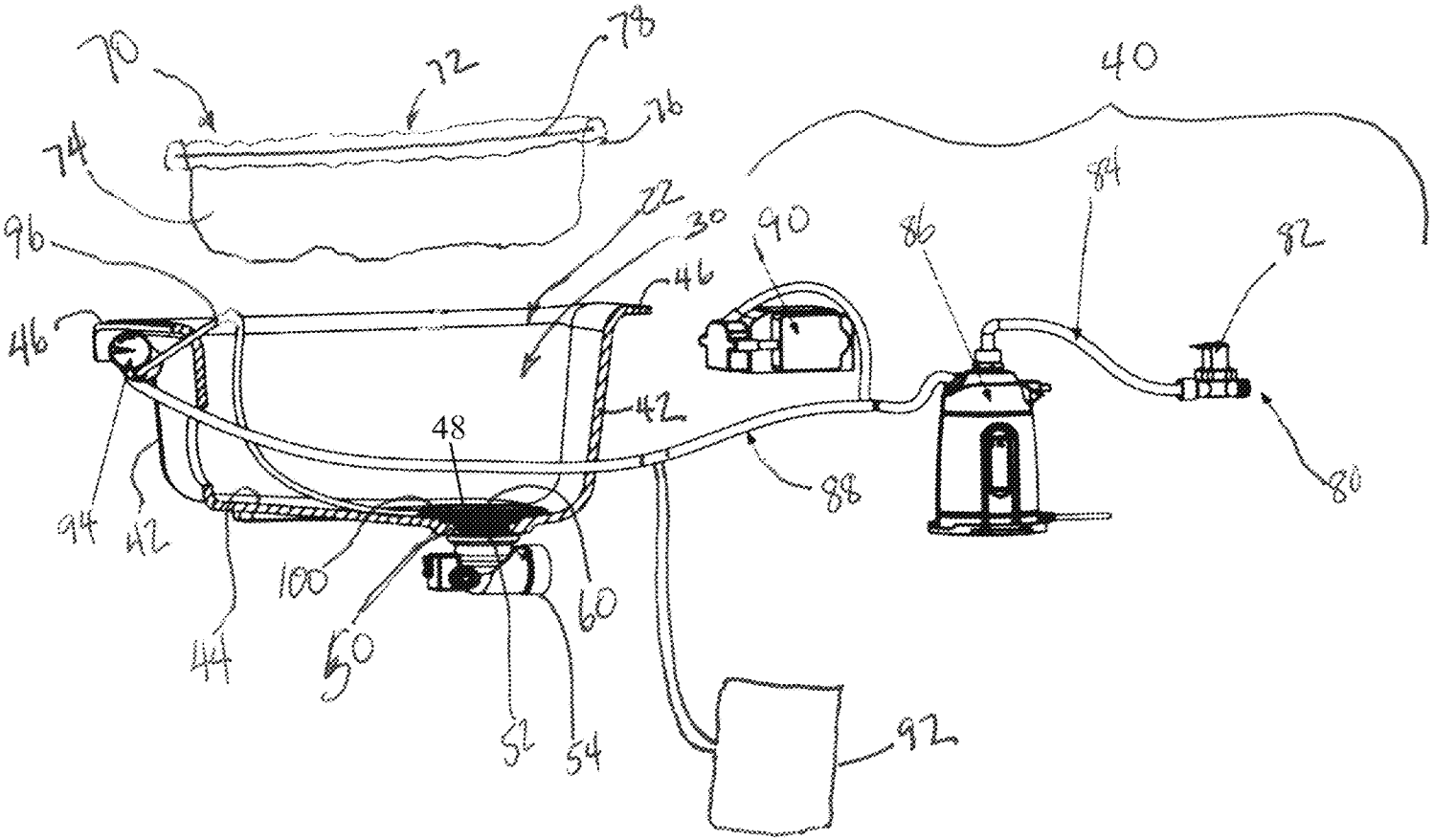
FIG. 2 is a schematic treatment fluid delivery system that is configured to selectively deliver treatment fluids into the basin.

With reference next to FIG. 2, an embodiment is illustrated showing a treatment fluid delivery system 40 that is configured to selectively deliver treatment fluids into the basin 22. Such treatment fluids typically are added to water that may already be held within the basin 22 to form an admixture, such as soap, ointment, herbal essences, etc. The basin 22, which is shown in cross-section, is defined by a plurality of side walls 42 and a bottom wall 44. A basin flange 46 is disposed along the side walls at a top edge of the basin 22. The basin includes a drain hole 48 formed through the bottom wall 44, into which a drain shoe 50 preferably is placed. The drain shoe 50 defines a drain passage 52 that leads from the basin cavity 30 to a drain pipe 54. A stopper 60 can be placed within the drain shoe 50 to block the flow of water from the basin 22 through the drain passage 52 and into the drain pipe 54. Further aspects of the drain shoe 50 are discussed below.

In some embodiments it is desired to employ a disposable liner 70 within the cavity 30 during use of the basin 22. Such use of a liner 70 improves sanitary conditions between a plurality of basin users, as the liner can be discarded and replaced after each user. In a preferred embodiment, the liner 70 is a thin, flexible, plastic material that serves as a liner 70 having an open top 72 and a body 74. A top edge 76 of the liner 70 may have an elastic band 78 disposed therein. As such, the top edge 76 can be advanced over the basin flange 46 so that the elastic band 78 holds the top edge 76 of the liner 70 below the basin flange 46 outside of the basin cavity 30. The body 74 of the liner 70, which is flexible and formable, then is pushed into the cavity 30 to line the interior of the basin, which can then be filled with water over the liner.

Continuing with reference to FIG. 2, the treatment fluid delivery system 40 can include a water inlet 80 configured to be attached to a source of water, preferably water under pressure. A solenoid-controlled valve 82 can be located in line with the inlet and configured so that water is supplied to the water pipe 84 for feeding water to the basin 22 when the solenoid valve 82 is open. The water pipe 84, which can optionally be tubing material, non-metallic or metallic pipe, delivers water to a steamer 86 or boiler, which is configured to heat the water, for example to form steam, which is then pushed into a delivery pipe 88. An air pump 90 can optionally be used to selectively supply air to the delivery pipe 90 to aerate the water. A secondary fluid product source 92 is also optionally provided and configured to selectively supply a secondary fluid product to the delivery pipe 88.

The delivery pipe 88 extends to a dispenser connection safety device 94 which, in the illustrated embodiment, is mounted on or adjacent the basin 22. A basin pipe 96 can be attached to the dispenser connection safety device 94 and extends therefrom into the cavity 30 of the basin 22 so as to deliver the treatment fluid to a dispenser 100 that is disposed within the cavity 30. In an example, the basin pipe 96 is configured to be discarded and replaced after each use. However, the basin pipes 96 can be configured for reuse, such as being cleanable and reusable. In some examples, the delivery pipe 88 and/or the basin pipe 96 may instead be appropriately graded tubing materials rather than piping materials.

The treatment fluid delivery system 40 preferably is configured so that treatment fluid can be selectively delivered to the basin 22 as desired and/or directed by a user. For example, a user can interact with one of the control panels 36, 38 (FIG. 1) to direct operation of the treatment fluid delivery system 40 and provide treatment fluid flow into the basis.

In one operation mode, the treatment fluid delivery system 40 is configured to deliver heated water from the steamer 86 to the dispenser 100, which can be viewed as a header or distributor to regulate or distribute flow into the basin 22, as further discussed below. In another operation mode, air from the air pump 90 can be added to such heated water so that steam and hot air is delivered to the basin 22 via the dispenser 100. In still other operation modes, air alone can be delivered. In yet further operation modes, various desired mixtures of air and heated water can be delivered.

Still further, in some embodiments the secondary fluid product source 92 can intermittently add a secondary fluid product to the mixture in the delivery pipe 88. Secondary fluid products can include fluids with additives that may enhance the user experience. For example, secondary fluid products can include scents, salts, herbs, and/or medicaments such as skin softeners. And it is to be understood that multiple types of secondary fluid products can be available and delivered as desired by a user.

Figures 3A, 3B:
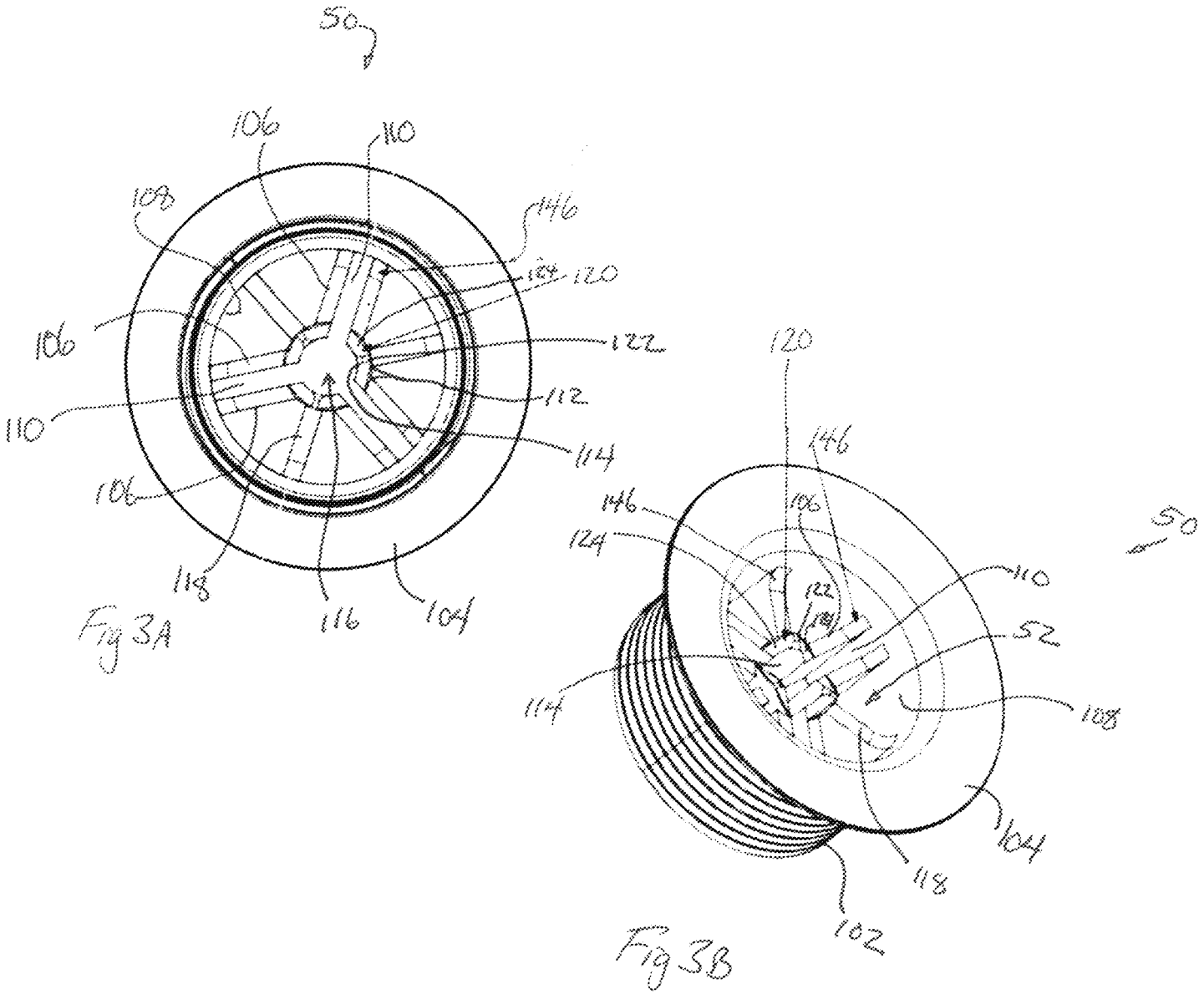
FIGS. 3A, 3B, and 4 depict an exemplary drain shoe useable with a drain hole of a pedicure chair basin.
Figure 4:
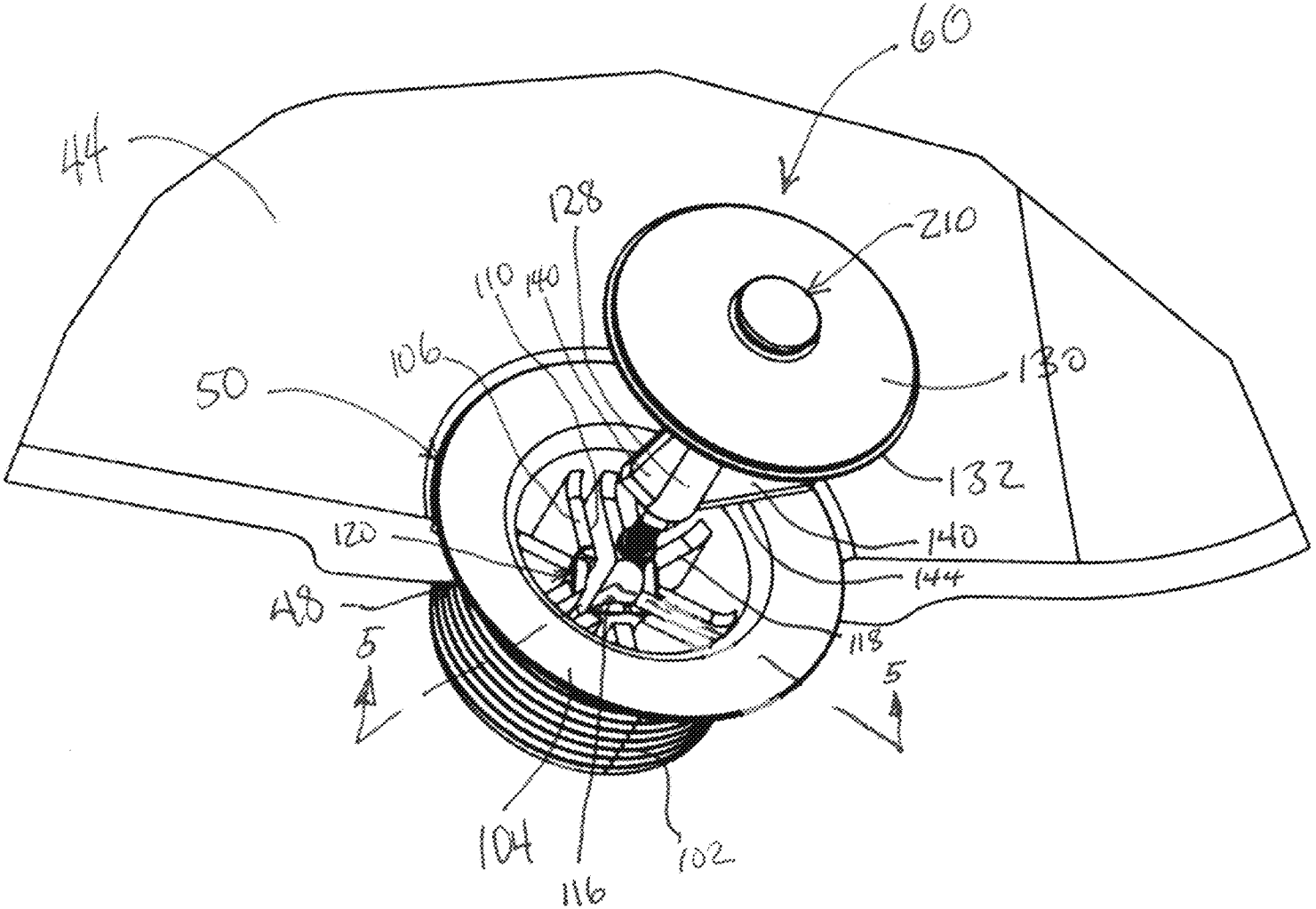

The drain hole 48 is formed through the bottom surface 44 of the basin 22. With reference next to FIGS. 3A, 3B and 4, an exemplary drain shoe 50 of FIG. 2 is shown. In an example, the drain shoe 50 can be disposed in the drain hole 48. The drain shoe 50 can comprise an elongated body 102 having external threads that enable the body 102 to be advanced into and retained in the basin drain hole 48, via threaded engagement. A shoe flange 104 extends outwardly at an upper end of the drain shoe 50. Preferably the drain shoe 50 is advanced into the basin drain hole 48 so that the shoe flange 104 seats against the basin bottom surface 44, as depicted in FIG. 4. Most preferably, the basin bottom surface 44 is configured so that the shoe flange 104 sits flush therewith, and functionally is part of the bottom surface 44. A gasket (not shown) may be used between the shoe flange 104 and the basin bottom surface 44 to improve water seal between the two. The drain shoe body 102 below the flange 104 is generally tubular, defining the drain passage 52 therethrough. In the illustrated embodiment, three pairs of guide walls 106 extend radially from an inner wall 108 of the drain passage 52. A guide slot 110 is defined between each pair of guide walls 106. The guide walls 106 terminate at inner ends 112, near the central region of the body 102, ring walls 114, connect the inner end of one guide wall 106 of each guide wall pair with the inner end 112 of the closest guide wall 106 of the adjacent guide wall pair. The ring walls 114 define a center passage 116 that is open to the guide slots 110. In the illustrated embodiment the guide slots 110 are oriented about 120 degrees relative to one another. Also, in the illustrated embodiment, between each pair of guide walls 106 a brace 118 extends radially inwardly from the inner wall 108 of the drain passage 52 to the closest ring wall 114. In the example shown, three ring walls 114 or three ring wall sections and three guide slots 110 are incorporated with the drain shoe 50. Other numbers of ring walls 114 and guide slots 110 are contemplated.

An aligner 120 is formed atop each ring wall 114. In the illustrated embodiment, the aligner 120 comprises a tip 122 from which inclined surfaces 124 depend on opposing sides. The inclined surfaces 124 slope downwardly from the tip 122 and terminate at the adjacent guide slot 110, forming an inclined path from the tip 122 to the guide slot 110. As such, a structure moving downwardly, upon contacting the inclined surface 124, will be directed into the adjacent guide slot 110.

Figure 5:
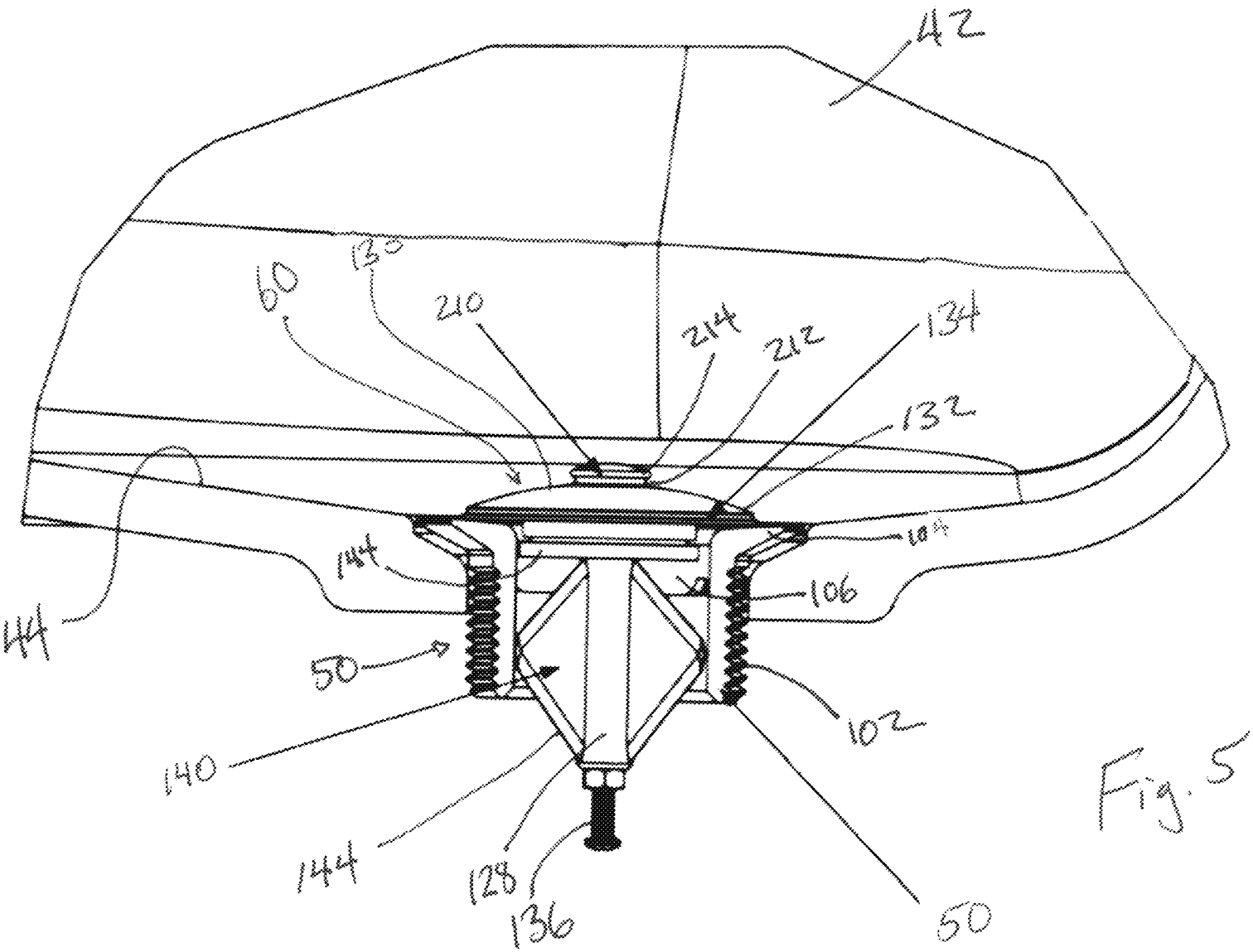
FIG. 5 is an exemplary stopper usable with a drain shoe in accordance with aspects of the invention.

With additional reference to FIG. 5, an exemplary stopper 60 is shown comprising an elongated body 128 depending from a head 130. The head 130 comprises a radially-extending head flange 132, which can be flat or can have an arc shape of a spherical section. An elastomeric gasket 134, such as a rubber gasket, is disposed adjacent the underside surface of the head flange 132. In use, the stopper 60 can be advanced into the drain passage 52 so that the elongated body 128 fits into and is received in the center passage 116 and extends through the drain shoe 50. When the stopper 60 is fully inserted as depicted in FIG. 5, the gasket 134 is sandwiched between the upper surface of the shoe flange 104, which, in the illustrated embodiment, can be considered part of the bottom surface 44 of the basin 22, and the head flange 132 of the stopper 60 so as to establish a seal that plugs the drain and enables the basin 22 to hold water. The stopper 60 can be held in place within the drain shoe 50 by gravity and/or by a column of water in the basin 22 above the stopper 60. A distal end of the elongate body 128 can include an adjustment member 136 that can be advanced or retracted in order to change the length of the elongated body 128. In the illustrated embodiment the adjustment member 136 comprises a threaded bolt.

Three blades 140 extend radially outwardly from the elongated body 128. A leading edge 142 of each blade 140 can be inclined relative to the longitudinal axis of the elongated body 128. Each blade 140 preferably is relatively thin so that it can fit readily through a corresponding guide slot 110. The blades 140 preferably are arranged so as to register with the guide slots 110. In the illustrated embodiment the blades 140 are disposed so as to cooperate with the guide slots 110 of the drain shoe 50 to allow the stopper 60 to be seated within the drain shoe 50 to plug the basin drain. In a particular example, the blades 140 are disposed 120 degrees from one another. As such, when the stopper 60 is properly aligned, the elongated body 128 will readily extend through the center passage 116 and the blades 140 will readily pass through respective guide slots 110 so that the stopper 60 can be fully inserted into the drain shoe 50.

With reference again to FIG. 4, the drain shoe 50 and stopper 60 are configured so that the blades 140 self-align with the guide slots 110. As the stopper 60 is inserted into the drain shoe 50 so that the stopper 60 is advanced downwardly relative to the drain shoe 50, the user will first ensure that the elongated body 128 fits into the center passage 116 defined by the ring walls 114. As the stopper 60 moves downwardly relative to the drain shoe 50, if the blades 140 are not aligned with the guide slots 110, the blades 140 will contact the inclined surfaces 124 of the aligners 120, which will cause the stopper 60 to rotate as it continues to be advanced. Eventually the stopper 60 will be rotated so that the blades 140 are aligned with the guide slots 110, and further advancement of the stopper 60 will see the blades 140 extend through such guide slots 110. In an example, a user can simply insert the elongated body 128 of the stopper 60 through the center passage 116, allow gravity and the aligners 120 to align the blades 140 with the guide slots 110, and then further depress the head 130 so that the stopper 60 is fully seated against the seat of the shoe flange 104.

In some embodiments, an inner portion 144 of the head 130 depends below the head flange 132. The inner portion 144 is configured to extend into the drain passage 52. Outer inclined surfaces 146 can be formed on one or more, or all, of the guide walls 110 and braces 118. The outer inclined surfaces 146 are sloped downwardly from the inner wall 108 of the drain passage 52 to the respective guide wall 110 or brace 118. If, when the stopper 60 is inserted into the drain shoe 50, the inner portion 144 of the head is off center, it may come in contact with one or more of the outer inclined surfaces 146 and be guided inwardly by cooperating surfaces so as to self-center the stopper 60 within the drain shoe 50.

Figure 6:
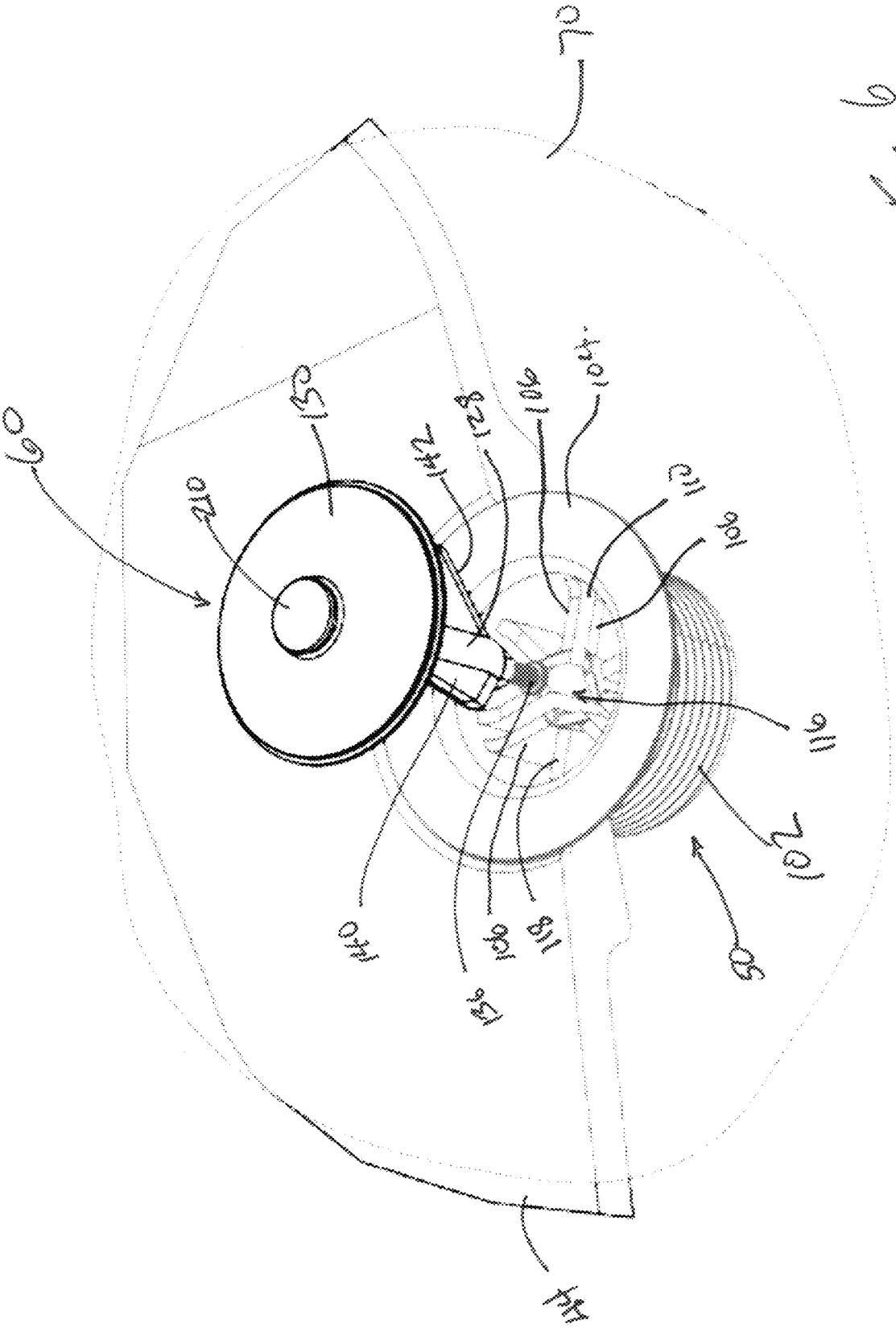
FIG. 6 shows a liner 70 used with a basin having a stopper and drain shoe in accordance with aspects of the invention.

FIG. 6 shows a liner 70 used with the basin 22. When a liner 70 is used with the basin 22, the liner 70 can be mounted or placed into the basin 22 before the stopper 60 is inserted into the drain shoe 50, and then water can be added to the basin 22. As such, the liner 70 lies upon the drain shoe 50. When the stopper 60 is then inserted into the drain shoe 50, the liner 70 will be urged against the upper surfaces of the guide walls 110 and aligners 120. These surfaces will at least partially restrain movement of the liner 70 relative to the stopper 60. As such, the distal end of the stopper elongated body 128 will deform and perhaps puncture the liner 70 when the stopper 60 is fully seated against the shoe flange 50. The liner 70 will be at least partially restrained by contact with the aligners 120 and the underside surface of the head flange 132. Further, as the leading edges 142 of the blades 140 are pushed through the respective guide slots 110, the liner 70 will be at least partially restrained by the upper surfaces of the guide wall 106 pairs, enabling the blades 140 to deform and cut or tear the liner 70 locally. As such, the liner 70 is cut, but the cut portions of the liner are contained within the drain passage 52. Thus, when the stopper 60 is fully inserted, the gasket 134 engages the intact portion of the liner 70 at the bottom surface 44 of the basin 22, and a watertight seal is maintained blocking the basin 22 from draining, while simultaneously the water is exposed only to the intact portion of the liner 70 and thus the surfaces of the basin 22 are not in direct contact with the water within the basin. Further, when an actuator lifts the stopper 60 so that the gasket 134 mounted to the stopper 60 is disengaged from the liner 70, water from the basin 22 can readily flow through the opening formed through the liner 70 within the drain passage 52, allowing the basin 22 to drain readily.

In some embodiments, the leading edges 142 of the blades 140 can be generally sharp to readily cut or puncture the liner 70. In additional embodiments the leading edges 142 need not be sharp, but the blades' complementary shape to the guide walls 106 and guide slots 110 enables a scissors-like operation, readily cutting the liner 70. Preferably, edges of the guide walls 106 and edges of the blade leading edges 142 are about 90 degrees, so as to enable scissors-like operation. In still additional embodiments, leading edges of the blades can include other cutting structures, such as serrations.

Figure 7:
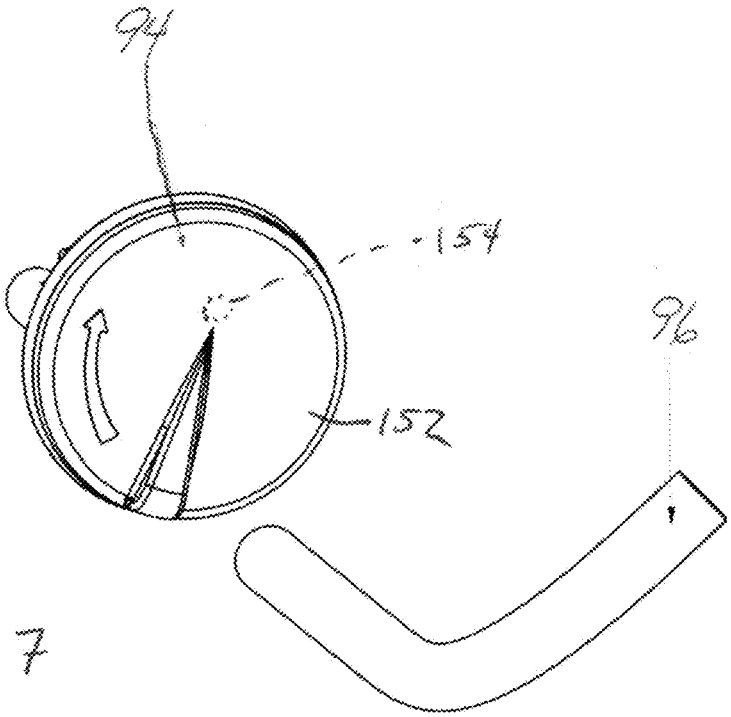
FIGS. 7 and 8 show an exemplary dispenser connection safety device having a lid and a base with a receiver.
Figure 8:
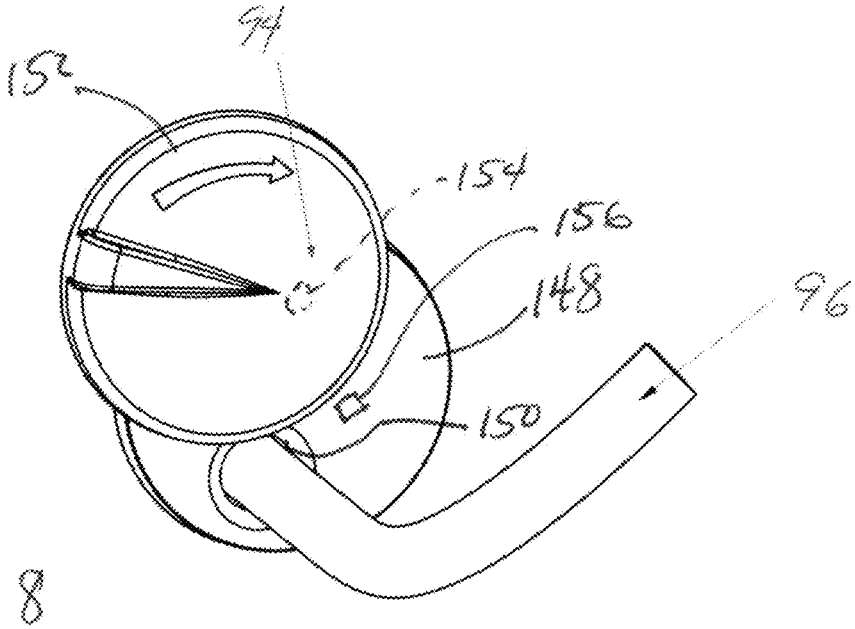

With reference again to FIG. 2 and additional reference to FIGS. 7 and 8, the delivery pipe 88 delivers treatment fluids to the dispenser connection safety device 94. As discussed above, in some operation modes the treatment fluids may hotter than comfort. The dispenser connection safety device 94 is configured to prevent operation of at least the steamer 86 unless certain conditions are met. In the illustrated embodiment, the dispenser connection safety device 94 comprises a base 148 that defines a pipe receiver 150. The pipe receiver 150 communicates with the delivery pipe 88 and is configured to receive an upstream end of a basin pipe 96. The basin pipe 96 is configured to extend from the pipe receiver 150 into the basin 22 and to the dispenser 100.

With specific reference to FIGS. 7 and 8, in the illustrated embodiment, a lid 152 is pivotally connected to the base 148, and is configured to cover the pipe receiver 150 when in a closed position as depicted in FIG. 7. Preferably, the lid 152 is configured to rotate about a pivot 154 that is spaced from an axis of the lid 152. As such, rotation of the lid 152 causes the lid to rotate eccentrically to an open position, as shown in FIG. 8, in which the pipe receiver 150 is exposed. In this open position, the upstream end of the basin pipe 96 can be inserted into the pipe receiver 150 and, when inserted, will block the lid 152 from rotating back to the closed position. Preferably the lid 152 is spring-biased toward the closed position. Thus, if the basin pipe 96 is not inserted into the pipe receiver 150, the lid 152 will automatically return to the closed position. Less preferably, the lid 152, due to the off-axis connection, can rotate under gravity to the close shut.

In a preferred embodiment, a kill switch or shutoff switch is actuated by the dispenser connection safety device 94. More specifically, the device 94 is configured so that when the lid 152 is in the closed position the kill switch is operable, and the steamer 86 cannot be turned on. Of course, the kill switch operation can also be applied to other components of the treatment fluid delivery assembly 40, and can be configured so that when the kill switch is operable any one of the components (such as the steamer 86, solenoid valve 82, air pump 90 or secondary fluid product source 92), a combination of two or more of such components, or all of the components, can be prevented from being operable.

When the lid 152 is in the open position, such that the basin pipe 96 can be inserted into the pipe receiver 150, the kill switch is not operable. As such, the relevant components of the treatment fluid delivery system 40 can be operated as directed by the user. Preferably, the kill switch is not configured to single-handedly turn any component on, but instead is configured only to prevent components from being operated when the kill switch is operable or activated.

In the illustrated embodiment, the kill switch 156 (shown schematically in FIG. 8) is supported on the base 148 so as to be actuated when the lid 152 is in the closed position, but unactuated when the lid 152 is in the open position. It is to be understood that other embodiments can employ various types of kill switches disposed in various positions. For example, in another embodiment a kill switch is unactuated by rotation of the lid 152 about the pivot 154. In other embodiments a position sensor or other sensor can detect the position of the lid and release the kill switch only when the lid is in the open position. In still other embodiments the kill switch, or even a supplemental kill switch, can be disposed within the pipe receiver 150 so that the kill switch is unactuated by the basin pipe 96 being inserted into the pipe receiver.

Figure 9:
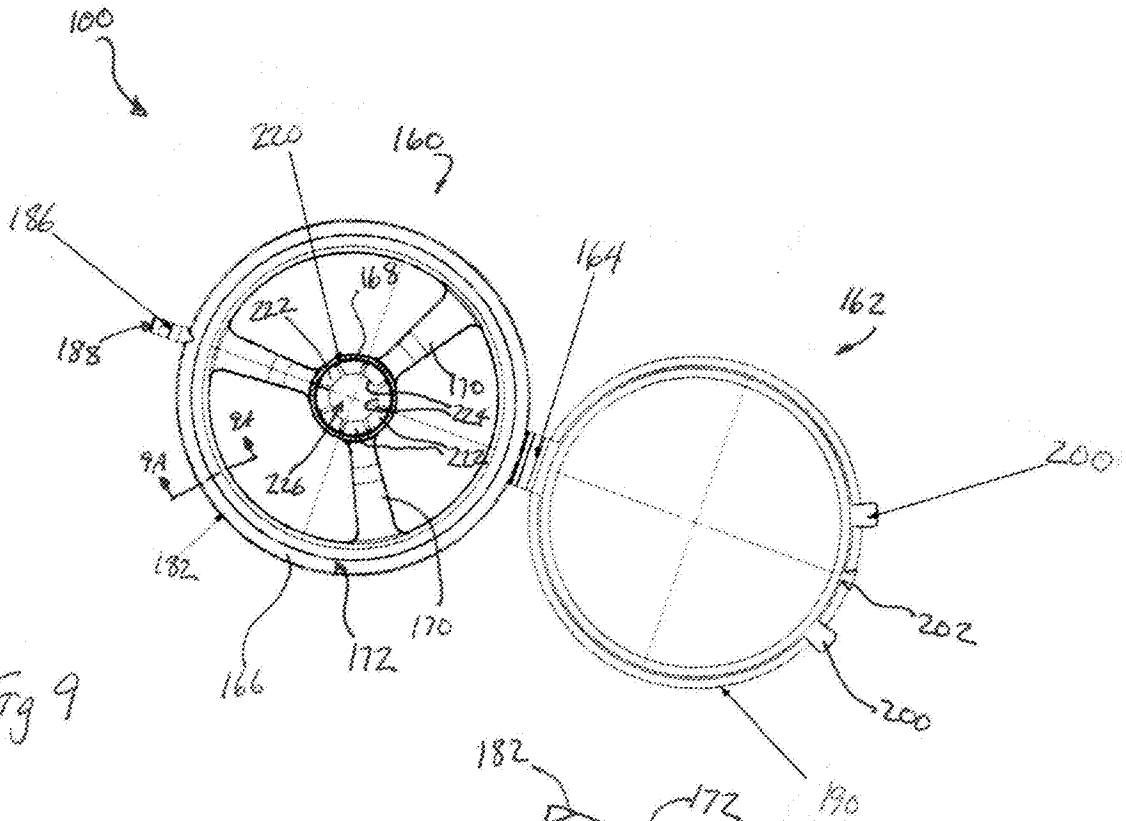
FIGS. 9 and 9A depicts a dispenser and a partial cross-sectional view of the dispenser in accordance with aspects of the invention.
Figures 10A, 10B:
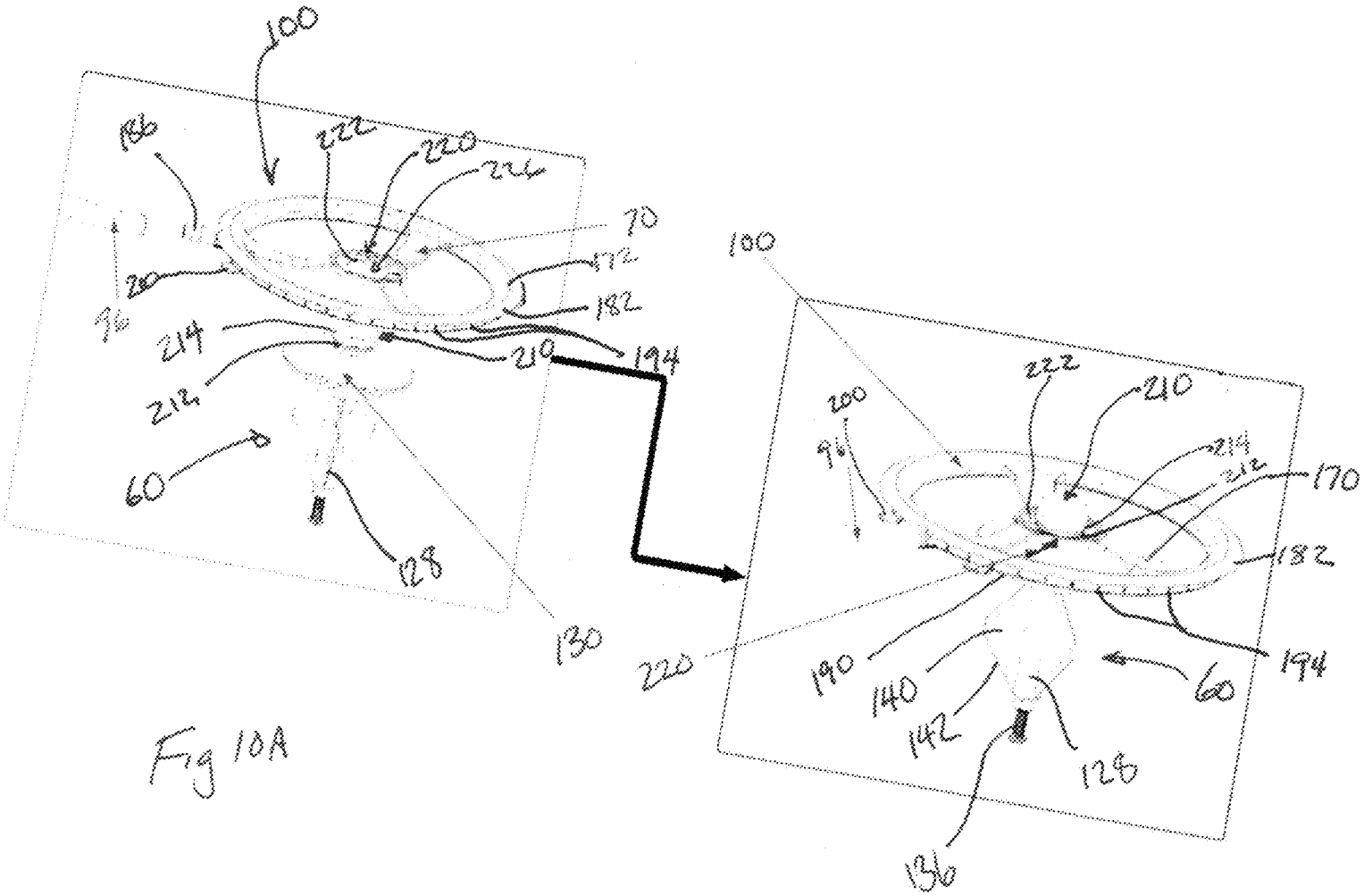
FIGS. 10A and 10B depict details of a dispenser in accordance with aspects of the invention.

With reference next to FIGS. 9-10B, a dispenser 100, which can be viewed as a header or distributor, is configured to distribute fluids received from the basin pipe 96 into the basin cavity 30. In the illustrated embodiment, the dispenser 100 comprises a first member 160 and a second member 162 that are connected to one another at a hinge 164 and are configured to releasably engage one another. When the first and second members 160, 162 are engaged, as depicted in FIGS. 10A and 10B, the dispenser 100 is in an operational configuration. When the first and second members 160, 162 are disengaged, as depicted in FIG. 9, the dispenser 100 is in a cleaning configuration.

Figure 9A:
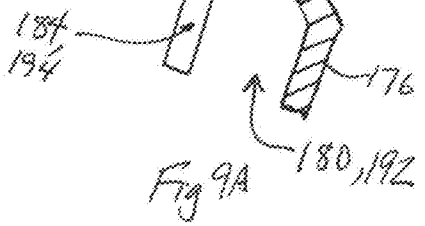

The first member 160 comprises an outer ring 166 and an inner ring 168 that are spaced apart from one another and connected by spokes 170. With particular reference to FIGS. 9 and 9A, the outer ring 166 has a top wall 172 that transitions, on its inner side, to a second wall 176. A first wall 174 depends from the top wall 172 and is positioned radially outwardly from the second wall 176 so that a circumferential cavity or slot 180 is defined between the first wall 174, top wall 172, and second wall 176. In the illustrated embodiment, an outer skirt portion 182 of the top wall 172 extends radially outwardly beyond the first wall 174. A plurality of spaced apart side cavities 184, or side slots, are formed in the first wall 174, preferably distributed generally evenly about the circumference of the outer ring 166. The side slots 184 preferably are open at their bottom ends and extend upwardly at least a portion of the length of the first wall 174. A hollow fluid connector 186 has an inlet 188 at one end, and connects at its opposite end to the outer ring 166 and is configured to open into the circumferential slot 180. The fluid connector 186 is configured to receive the basin pipe 96 thereon. As such, the fluid connector 186 communicates the basin pipe 96 with the circumferential slot 180.

The second member 162 has a bottom wall 190 that is configured to engage the bottom ends of the first wall 174 and second wall 176. As such, and with additional reference to FIGS. 10A and 10B, when the first and second members 160, 162 are engaged, the bottom wall 190 encloses the circumferential slot 180 so as to define a manifold 192. Also, the bottom wall 190 closes the ends of the side slots 184, forming a plurality of delivery openings 194 that communicate the manifold 192 with the surrounding environment. As such, fluid delivered to the manifold 192 via the basin pipe 96 is distributed circumferentially about the dispenser 100 to the basin cavity 30.

In a preferred embodiment, the second member 162 is configured to be press-fit onto the first member 160, or vice versa, when in the operation configuration. Any desired structure, such as a detent, close-fitting wall, or the like, can be configured to hold the first member 160 and second member 162 together when in the operation configuration. The second member 162 can have one or more tabs 200 extending radially outwardly from the bottom wall 190 so as to help a user obtain purchase on the second member 162 so that opposing pressure can be applied to separate the first member 160 from the second member 162 when desired to move from the operation configuration to the cleaning configuration.

The illustrated dispenser 100 is configured to facilitate easy cleaning. As shown, the manifold 2-3 and delivery openings 194 of the dispenser 100 are not permanently enclosed. For example, although the manifold 192 and delivery openings 194 are enclosed when the dispenser 100 is in the operation configuration, these structures are open and accessible, as the circumferential slot 180 and side slots 184, respectively, when the dispenser 100 is in the cleaning configuration. As such, thorough and complete cleaning is easily accomplished, and the dispenser 100 can be sanitized and reused.

The illustrated first member 160 and second member 162 are connected at the hinge member 164. In additional embodiments the first member 160 and second member 162 can be formed separately from one another. In some embodiments the second member 162 can have structure, such as an inlet receiver 202, that is configured to accommodate structure of the first member 160 in order to ensure that the first member 160 and second member 162 are aligned as desired when placed in the operation configuration. In additional embodiments the second member 162 need not be aligned in any specific rotational location to sufficiently engage the first member 160 so as to form the manifold 192 and delivery openings 194. Further, the illustrated dispenser 100 has a circular configuration. Additional embodiments can have other configurations, such as oval, square, rectangular, and/or having one or more manifold portions that extend inwardly and/or outwardly from a central slot/manifold.

With continued reference to FIGS. 9-10B and reference again to FIG. 5, an attachment member 210 extends upwardly from the head 130 of the stopper 60. The attachment member 210 preferably comprises a circumferential slot 212 having a slot diameter and an adjacent circumferential ridge 214 having a ridge diameter that is greater than the slot diameter. The inner ring 168 of the illustrated dispenser 100 defines a connector 220 that comprises a plurality of inwardly-extending flexible tabs 222. Each tab 222 terminates at an inner end 224. The inner ends 224 together define a generally circular central passage 226 defining a connector diameter. In a preferred embodiment the ridge diameter is greater than the connector diameter, and the connector diameter is greater than or approximately the same as the slot diameter. As such, when the connector 220 is advanced over the attachment member 210, the flexible tabs 222 deflect as they are drawn over the circumferential ridge 214. Once advanced past the circumferential ridge 214, the tabs 222 will then be received into the circumferential slot 212 as depicted in FIG. 10B, preferably in a snap-fit configuration. In this configuration, the connector 220 is connected to and retained by the circumferential slot 212 and circumferential ridge 214, and the connector 220 can only be removed if sufficient upwardly-directed force is applied so that the flexible tabs 222 are deflected, and the connector 220 drawn upwardly over the circumferential ridge 214. In this manner, the connector 220 and attachment member 210 enable the dispenser 100 to be releasably connected to the stopper 60. Preferably the dispenser 100 is attached to the stopper 60 so that the first member 160 is above the second member 162, and the top wall 172 faces upwardly.

As discussed above, the stopper 60 can be inserted into the drain shoe 50 to close the drain passage 52. In this configuration the stopper 60 is at the bottom of the basin 22. As also just discussed, the dispenser 100 can be attached to the stopper 160. As such, the dispenser 100 can be held at the bottom of the basin cavity 30 by the stopper 60. The dispenser 100 thus is held securely in place, and is prevented from floating or otherwise moving around within the basin 22 during use. In the illustrated embodiment the spokes 170 between the inner and outer rings 168, 166 of the dispenser 100 are configured so that the outer ring 166 rests at or adjacent the bottom surface 44 of the basin 22. In use, a user seated on the pedicure chair 24 can rest their feet directly upon the top wall 172 of the dispenser 100. Although steam and/or water can be very hot when it is dispensed through the delivery openings 194 into the basin cavity 30, the outer skirt 182 of the dispenser top wall 172 shields the user's feet from direct contact with the delivery openings 194, and the fluid dispensed therethrough contacts the surrounding environment at least briefly before travelling around the outer skirt 182 and into contact with the user's foot. Further, the delivery openings 194 can be sized and shaped to limit the rate at which steam is delivered therethrough. As such, the fluid is dispersed and cooled by the other fluid in the basin 22, protecting the user's foot from burns.

The dispenser 100 can be formed of any of a variety of materials. Most preferably it is formed of a ceramic or plastic material having relatively slow heat transfer properties so as to slow or prevent excessive heat from being delivered to the user's feet, which may be direct in contact therewith.

In embodiments discussed above, the drain shoe 50 and stopper 60 have been depicted having a specific structure with three blades 140 and three pairs of guide walls 106 that define three guide slots 110. It is to be understood that other embodiments can employ other structures that employ similar inventive principles. For example, other embodiments can employ other configurations of guide walls or the like that support a liner 70 and restrain a liner from easily deforming when a complementary structure of the stopper 60 is advanced into the drain shoe 50. As such, the drain shoe 50 and stopper 60 work together to puncture and/or cut the liner 70 locally so that draining through the drain passage 52 is enabled, but the liner remains intact outside of the drain passage.

It is to be understood that control interfaces, such as control panel 36 or control panel 38, can be used to interact with one or more controllers, such as a steamer controller, air pump controller, and/or a water dispenser controller, to transmit operation instructions to such components as desired. Control panel 36 and 38 could be configured to have similar user interfaces, different user interfaces, or could be configured to control non-overlapping functionality. For example, control panel 36 could be configured control a first set of functions and control panel 38 could be configured to control a second set of functions that are a subset of the first set of functions. This enables a technician or worker to control the water temperature and other parameters while a user of the chair controls a subset of functions. Control panel 36 could include different toggle switches or dial knobs, an on/off switch, and an emergency override, as non-limiting examples. In some embodiments, chair 24 could have only one control panel, such as only control panel 36 operated by a technician, or only control panel 38 operated by a user of the chair 24.

In some embodiments, a controller of a foot therapy system, such as a steamer controller or a water dispenser controller, could be a relay station that relays commands directly from a control panel, such as control panel 38, while in other embodiments the controller could be a computer system having its own processor and memory. As used herein, a "computer system" comprises any suitable combination of computing or computer devices, such as desktops, laptops, cellular phones, blades, servers, interfaces, systems, databases, agents, peers, engines, modules, or controllers, operating individually or collectively. Computer systems and servers may comprise at least a processor configured to execute software instructions stored on a tangible, non-transitory computer readable storage medium (e.g., hard drive, solid state drive, RAM, flash, ROM, etc.). The software instructions preferably configure the computer system and server to execute the functionality as disclosed. As used herein, a "unified gateway" comprises an improved routing device that dynamically bridges communication gaps between data transceivers that have differing transmission, security, and overhead restrictions and metrics.

In preferred embodiments, the controller comprises a simple computer system having a programmable EEPROM chip that saves simple instructions, for example an instruction to activate the steamer until a minimum temperature threshold is detected, upon which the chip transmits a command to deactivate the steamer, or a command to activate a water dispenser for a period of time, or until a threshold volume of water is reached within the cavity 30 of basin 22. One or more sensors could be functionally coupled to the controller to assist in executing such commands, such as a thermometer sensor (not shown) within the cavity 30 of basin 22 that transmits a detected temperature to the controller, or a water level sensor (not shown) within the cavity of basin 22 that transmits a notification to the controller when the sensor is submerged by water. The water sensor could comprise, for example, an electro-mechanical sensor having at least two prongs exposed to the cavity of basin 22 or projecting into the cavity of basin 22 to sense water level through contact with the water. Whether the level sensor is of a two-prong type or other types, such as a magnetic switch type, or a ball float type, direct contact between the water and a component of the level gauge is preferable. Other commercially available switches, control mechanisms, thermocouples, and sensors are contemplated and can be used with the pedicure chair assembly, such as an on/off button and switches for controlling other functions incorporated with the chair, such as to controlling moving massage elements or turning on music.

Control panel 36 and/or 38 could also comprise a display that displays one or more parameters, such as measured water temperature, desired water temperature, elapsed time, total time, massage status, light status, steamer status, or other parameters. Such displays are preferably touch screen displays that display indicators that are selectable which the user can interact with.

The embodiments discussed above have disclosed structures with substantial specificity. This has provided a good context for disclosing and discussing inventive subject matter. However, it is to be understood that other embodiments may employ different specific structural shapes and interactions.

Although inventive subject matter has been disclosed in the context of certain preferred or illustrated embodiments and examples, it will be understood by those skilled in the art that the inventive subject matter extends beyond the specifically disclosed embodiments to other alternative embodiments and/or uses of the invention and obvious modifications and equivalents thereof. In addition, while a number of variations of the disclosed embodiments have been shown and described in detail, other modifications, which are within the scope of the inventive subject matter, will be readily apparent to those of skill in the art based upon this disclosure. It is also contemplated that various combinations or sub-combinations of the specific features and aspects of the disclosed embodiments may be made and still fall within the scope of the inventive subject matter. Accordingly, it should be understood that various features and aspects of the disclosed embodiments can be combined with or substituted for one another in order to form varying modes of the disclosed inventive subject matter. Thus, it is intended that the scope of the inventive subject matter herein disclosed should not be limited by the particular disclosed embodiments described above, but should be determined only by a fair reading of the claims that follow.

What is claimed is:

1. A pedicure basin, comprising:

a side wall and a bottom surface;

a drain hole disposed in the bottom surface;

a stopper configured to extend into the drain hole, the stopper having a head comprising a stopper flange configured to engage the bottom surface adjacent the drain hole so as to plug the drain hole, an attachment member extending from the head; and a dispenser having a connector configured to releasably engage the attachment member so as to hold the dispenser connected to the head of the stopper;

wherein when the connector is engaged with the attachment member the dispenser is held in place in the basin by the stopper; and wherein an upper opening of the basin is located below a seating surface of a pedicure chair.

2. The pedicure basin of claim 1, wherein the connector comprises at least one inwardly-directed flexible tab and the attachment member comprises a slot, and wherein when the connector is advanced over the attachment member the flexible tab is retained within the slot.

3. The pedicure basin of claim 1, wherein the attachment member comprises a circumferential ridge disposed above the circumferential slot, and the connector comprises a ring having at least one flexible tab extending inwardly from the ring, a connector diameter being defined between inwardmost ends of diametrically-opposed portions of the at least one flexible tab, and wherein a maximum diameter of the circumferential ridge is greater than the connector diameter.

4. The pedicure basin of claim 1, wherein the dispenser comprises a first member and a second member, the first member having a fluid connector and an elongated slot having a first side wall and a second side wall, the elongated slot communicating with the fluid connector, a plurality of side slots formed through the first side wall, the second member configured to mate with the first member so as to enclose the elongated slot to define a manifold and to close the side slots so as to define delivery openings communicating with the manifold.

5. The pedicure basin of claim 1, wherein the first member is hingedly connected to the second member.

6. The pedicure basin of claim 1, wherein the elongated slot defines a circle, and wherein a top wall of the first member comprises a skirt portion that extends radially outwardly from the first side wall.

7. A pedicure basin, comprising:

a side wall and a bottom surface;

a drain hole disposed in the bottom surface;

a drain shoe fitted into the drain hole, the drain shoe defining an elongated drain passage having a guide wall pair extending transversely from an inner wall of the drain passage, the guide wall pair defining a guide slot therebetween; and a stopper configured to extend into the drain shoe, the stopper having a head comprising a stopper flange configured to engage the bottom surface adjacent the drain shoe so as to plug the drain hole, the stopper having an elongated body extending from the head and having a blade extending radially outwardly from the elongated body;

wherein when the stopper is placed into the drain shoe, the blade slides within the guide slot.

8. The pedicure basin of claim 7, wherein the elongated body of the stopper has a plurality of blades extending radially outwardly from the elongated body, and the drain shoe comprises a corresponding plurality of guide wall pairs that each define a guide slot therebetween, and wherein the plurality of guide slots are arranged complementary to the plurality of blades.

9. The pedicure basin of claim 8, additionally comprising a plurality of ring walls defining a center passage of the drain passage, the center passage sized to accommodate the elongated body of the stopper.

10. The pedicure basin of claim 9, additionally comprising an aligner atop at least one of the ring walls, the aligner having a tip and an inclined surface sloping downwardly from the tip to an adjacent guide slot.

11. A method of establishing a drain in a pedicure basin having a bottom surface and a drain passage defined by a drain shoe, comprising:

installing a thin, flexible liner into a pedicure basin so that a bottom portion of the liner overlies the drain shoe, the drain shoe having a plurality of guide slots defined between a corresponding plurality of guide wall pair that extend inwardly from an inner wall of the drain passage, an aligner having a tip and an inclined surface sloping downwardly from the tip to a corresponding guide slot;

advancing a stopper into contact with the liner and into the drain passage so that a blade of the stopper contacts the aligner;

allowing the stopper to rotate about a vertical axis as the blade slides over the inclined surface until the blade is aligned with the guide slot; and advancing the stopper downwardly so that the blade moves downwardly through the guide slot, the guide wall pair restricts movement of the liner relative to the guide slot, and the blade cuts through the liner.

12. A pedicure chair comprising a basin, said basin comprising:

a side wall and a bottom surface;

a drain hole disposed in the bottom surface;

a drain shoe fitted into the drain hole, the drain shoe defining an elongated drain passage and having an aligner with inclined surfaces;

a stopper configured to extend into the drain shoe, the stopper having a head and an elongated body extending from the head and having a blade extending radially outwardly from the elongated body that is sized and shaped to be rotated by the aligner;

a dispenser having a connector and an attachment member;

wherein when the connector is engaged with the attachment member the dispenser is held in place in the basin by the stopper.

13. The pedicure chair of claim 12, further comprising a dispenser connection safety device attached to the basin, the dispenser connection safety device comprising a lid that is pivotably connected to a base.

14. The pedicure chair of claim 13, further comprising a pipe receiver comprising an opening located on the base and sized and shaped to receive a fluid line.

15. The pedicure chair of claim 12, wherein the connector on the dispenser is located internally of an outer ring.

16. The pedicure chair of claim 15, further comprising a plurality of spaced apart spokes connecting the outer ring to the connector.

17. The pedicure chair of claim 12, further comprising a second member hingedly connected to the outer ring and configured to pivot away from the outer ring to expose a plurality of slots.

18. The pedicure chair of claim 12, further comprising a steamer in fluid communication with the dispenser through a delivery pipe for providing heated fluid to the dispenser.

19. The pedicure chair of claim 18, further comprising a secondary fluid container in fluid communication with the delivery pipe.

20. The pedicure chair of claim 19, further comprising an air pump in fluid communication with the delivery pipe.

* * * * *